US006061963A

United States Patent [19]

Osborn et al.

[11] Patent Number: 6,061,963

[45] Date of Patent: May 16, 2000

[54] WINDOW REGULATOR MECHANISM

[75] Inventors: Thomas Ralph Osborn, Dearborn Heights; David A. Sedlak, Clarkston; Lloyd Walker Rogers, Jr., Shelby Township, Macomb County; Joseph Michael Johnson, Huntington Woods, all of Mich.

[73] Assignee: General Motors Corporation, Detroit, Mich.

[21] Appl. No.: 09/305,514

[22] Filed: May 5, 1999

[51] Int. Cl.[7] ..... E05F 11/48

[52] U.S. Cl. ..... 49/352

[58] Field of Search ..... 49/348, 349, 352, 49/502; 474/135, 133, 138, 117, 112, 101, 140, 139

[56] References Cited

U.S. PATENT DOCUMENTS

| | | | |
|---|---|---|---|
| 4,672,771 | 6/1987 | Lam et al. . | |
| 4,785,582 | 11/1988 | Tokue et al. . | |
| 4,839,990 | 6/1989 | Lam et al. . | |
| 5,079,871 | 1/1992 | Acciacca et al. . | |
| 5,309,678 | 5/1994 | Adachi | 49/352 |
| 5,505,022 | 4/1996 | Shibata et al. | 49/352 |
| 5,535,553 | 7/1996 | Staser et al. . | |
| 5,799,441 | 9/1998 | Shibata | 49/352 |

FOREIGN PATENT DOCUMENTS

| | | | |
|---|---|---|---|
| 491917 | 4/1953 | Canada | 49/352 |
| 5287953 | 11/1993 | Japan | 49/352 |

*Primary Examiner*—Jerry Redman
*Attorney, Agent, or Firm*—Kathryn A. Marra

[57] ABSTRACT

A window regulator mechanism for raising and lowering a window that slides up and down in a hollow closure. The window regulator mechanism includes a base plate that supports a tape drive that pulls the window up and pulls the window down. The tape wraps around upper and lower rollers that rotate on axes that are substantially parallel to the length of the closure. Two slack take-up devices for the tape are disclosed. An alternate window regulator mechanism drives the tape with conformation and does not need any slack take-up.

16 Claims, 6 Drawing Sheets

WINDOW REGULATOR MECHANISM

TECHNICAL FIELD

This invention relates to vehicle doors, lift gates and other closures equipped with moveable windows and more particularly to a window regulator mechanism that is housed within the vehicle door, lift gate or other closure for raising and lowering the window.

BACKGROUND OF THE INVENTION

Automotive vehicles have doors, lift gates and other closures that are commonly equipped with a window. In many instances the window is moveable to provide an open passage between the vehicle interior and the vehicle exterior. Moveable windows often slide up and down between a raised closed position and a lowered open position where the window is at least partially stored in the vehicle door, lift gate or other closure.

Several types of window regulator mechanisms are now used to raise and lower the window. Known mechanisms include cross arm mechanisms, single arm mechanisms, cable mechanisms and tape mechanisms.

U.S. Pat. No. 4,672,771 granted to Michael K. Lam et al on Jun. 16, 1987 and U.S. Pat. No. 4,839,990 granted to Michael K. Lam et al on Jun. 20, 1989 disclose typical tape drive mechanisms. The typical tape drive mechanism generally comprises a flat plastic drive tape that is fitted around a sprocket wheel and the tape has spaced transverse apertures or other conformations that cooperate with the sprocket wheel to drive the tape.

While such tape drive mechanisms have been used successfully in the past, the mechanisms have a draw back in that the tape travels inside the closure with its width oriented perpendicular to the length of the closure. The middle and lower portions of the closures are generally wide enough to accommodate the width of the tape. However there are often space limitations at the window sill area which is preferably as thin as possible for ascetic and other reasons. In the past, the space problem has been solved by stopping the window sash plate well below the window sill. This solution is not entirely satisfactory because, the door height must be increased to store the window in the open or down position which inhibits design freedom.

Another drawback of known tape drive mechanism of the type discussed above is that the tape pushes the window in one direction, usually down, and pulls the window in the other direction, usually up. Since the tape acts in compression as well as in tension, the tape is thick as well as wide in order to handle the compressive loads. This decreases the flexibility of the tape and inhibits routing the tape inside the vehicle door.

Furthermore, the tape is often routed through tape channels that follow the curvature of the windows. These curved tape channels edge bend the tape resulting in high frictional resistence when the tape is pushed through the tape channel. Thus, systems requiring curved tape channels are very inefficient because large drive motors or considerable manual effort is required to move the window in one direction, usually down.

SUMMARY OF THE INVENTION

In one aspect an object of the invention is to provide a window regulator mechanism of the tape drive type wherein the tape drive pulls the window in both directions resulting in a tape that is inherently more flexible and thus easier to route than tapes used in the past that were required to push the window in one direction and thus carry compressive loads.

In this first aspect, a feature of the invention is that the window regulator mechanism has a tape that pulls the window in both directions thereby allowing the use of a more flexible tape that is easier to route inside the vehicle door, lift gate or other closure.

Another feature of the invention in this first aspect is that the window regulator mechanism uses a flexible tape that is twisted so that it travels part way with its width parallel to the length of the vehicle door, lift gate or other closure.

Yet another feature of the invention in this first aspect is that the window regulator mechanism does not require any tape channels thereby reducing the power or manual effort required to operate the window regulator mechanism.

In another aspect, an object of the invention is to provide a window regulator mechanism of the tape drive type that requires very little space in the sill area of the vehicle door, lift gate or other closure resulting in greater design freedom.

In this second aspect, a feature of the invention is that the window regulator uses a tape in the form of a very thin flexible web that results in a mechanism that requires very little space in the sill area of the vehicle door, lift gate or other closure thereby providing considerable design freedom and/or increasing the permissible window height.

These and other objects, features and advantages of the invention will become more apparent from the following description of a preferred embodiment taken in conjunction with the accompanying drawing.

BRIEF DESCRIPTION OF THE DRAWINGS

The presently preferred embodiment of the invention is disclosed in the following description and in the accompanying drawings, wherein.

DETAILED DESCRIPTION OF THE PREFERRED EMBODIMENT

Figure 1:
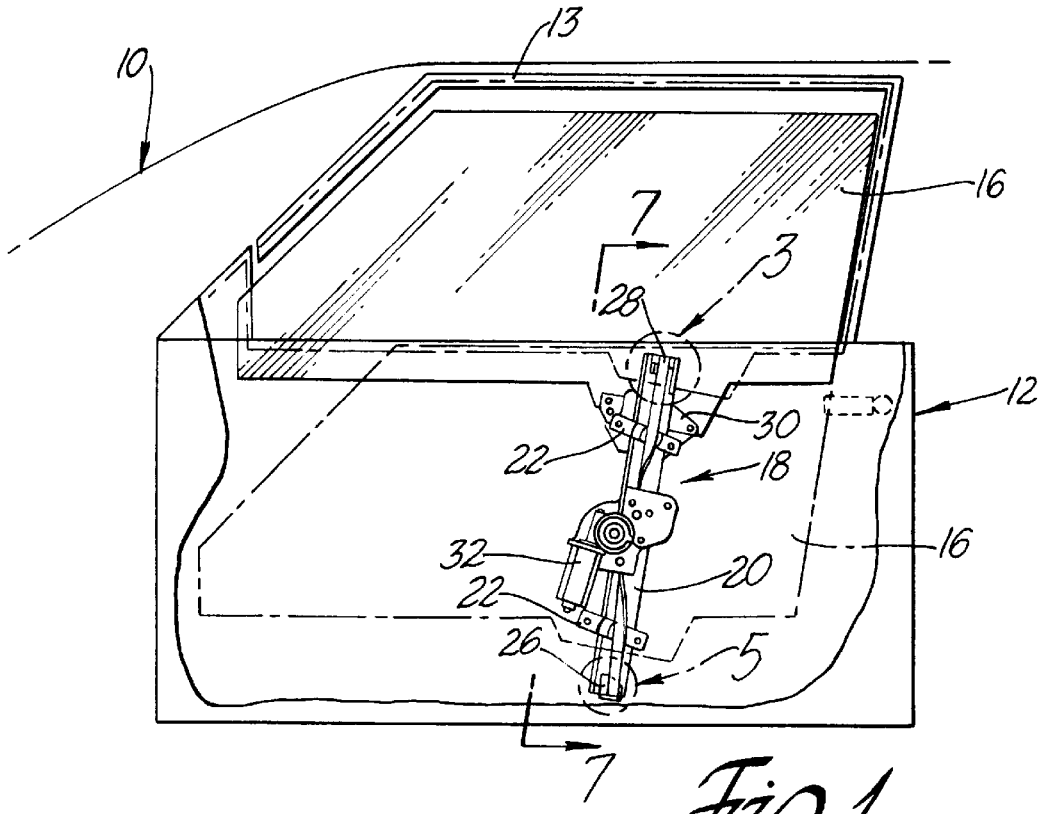
FIG. 1 is an interior view of a vehicle closure equipped with a window regulator mechanism of the invention.

Referring now to FIG. 1, vehicle 10 has a door or closure 12 that is attached to the forward pillar of the vehicle by two hinge assemblies (not shown) so that the door swings from a closed position to an open position providing an open passage for entering and exiting the interior passenger compartment of the vehicle. Closure 12 is equipped with a window 16 that slides up and down in a window frame 13 between a raised closed position and a lowered open position where the window is stored in the vehicle closure 12 as shown in dashed line in FIG. 1.

Figure 3:
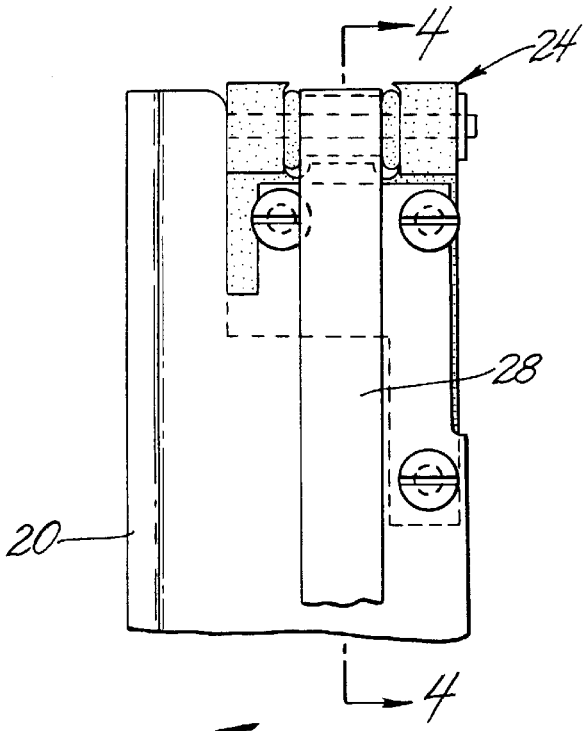
FIG. 3 is an enlargement of the window regulator mechanism shown in area 3 of FIG. 1.
Figure 4:
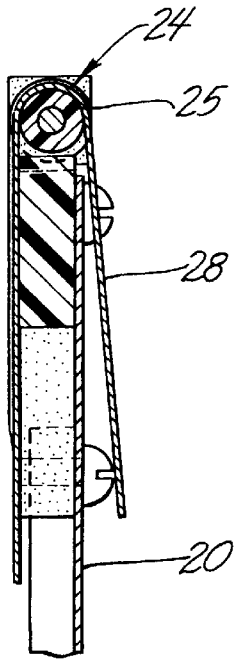
FIG. 4 is a section taken substantially along the line 4—4 of FIG. 3 looking in the direction of the arrows.
Figure 2:
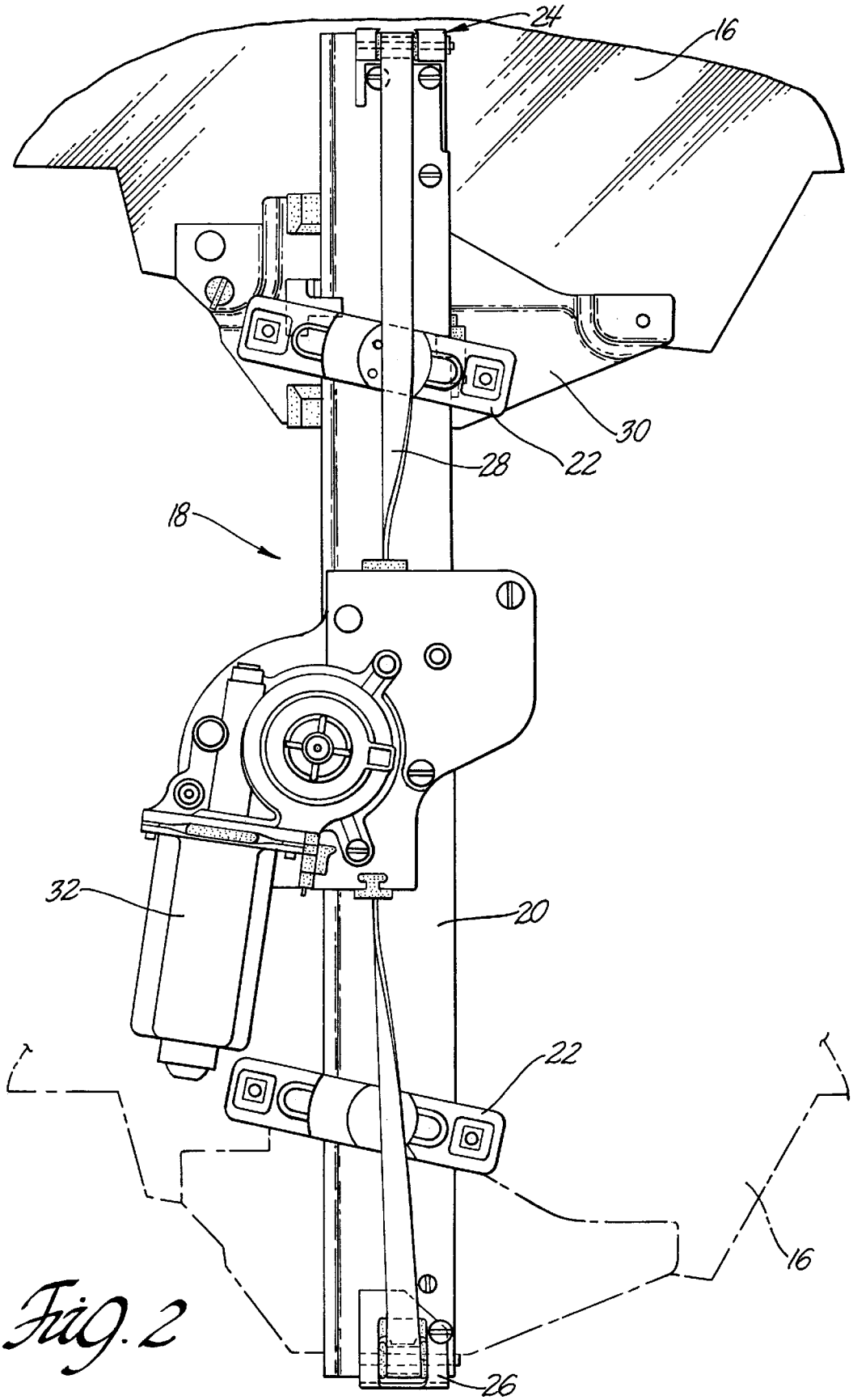
FIG. 2 is an enlarged interior view of the window regulator mechanism shown in FIG. 1.
Figure 5:
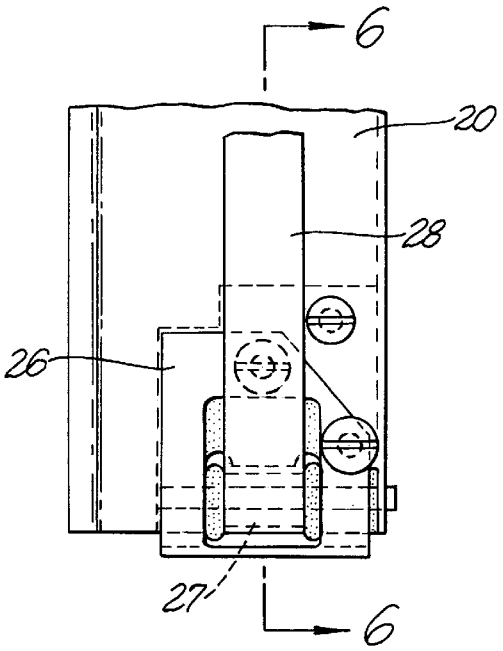
FIG. 5 is an enlargement of the window regulator mechanism shown in area 5 of FIG. 1.
Figure 6:
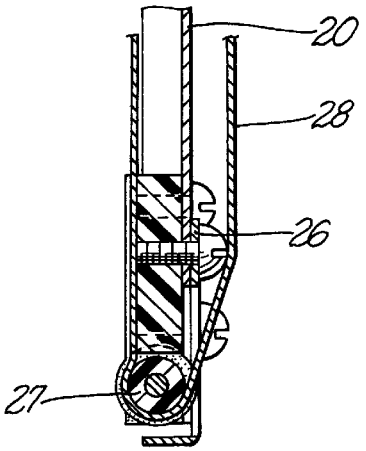
FIG. 6 is a section taken substantially along the line 6—6 of FIG. 5 looking in the direction of the arrows.
Figure 7:
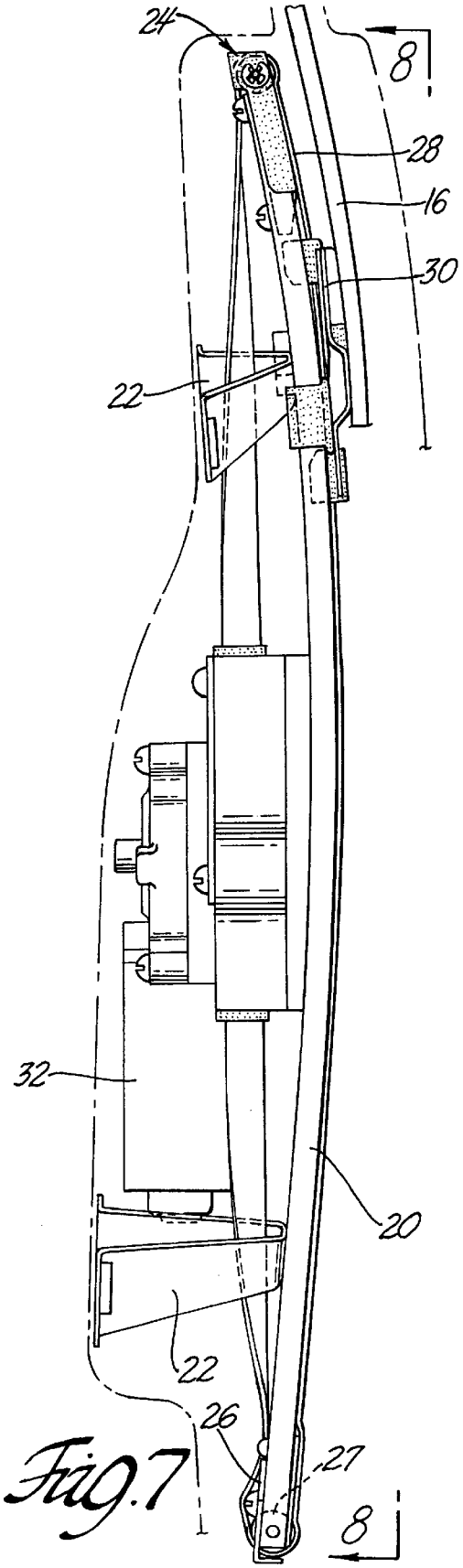
FIG. 7 is a side view of the window regulator mechanism taken substantially along the line 7—7 of FIG. 1 looking in the direction of the arrows.

Window 16 is moved by a window regulator mechanism indicated generally at 18. Window regulator mechanism 18 comprises a base plate 20 that is disposed in a space between inner and outer panels of closure 12. Base plate 20 is secured to the inner panel by brackets 22 (FIG. 7). Base plate 20 has an upper roller assembly 24 at the upper end (FIGS. 3 and 4) and a lower roller assembly 26 at the lower end (FIGS. 5 and 6).

Figure 8:
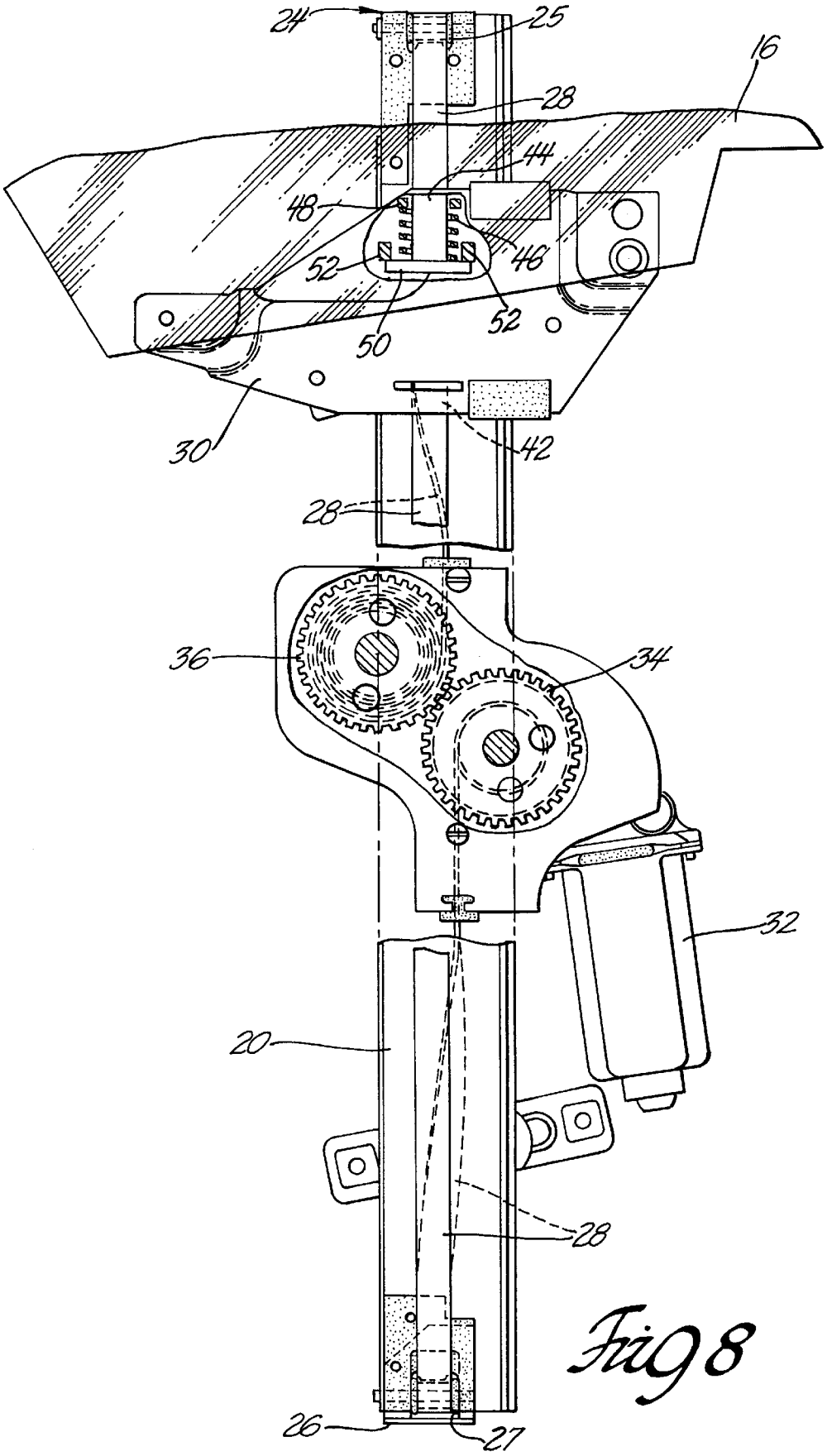
FIG. 8 is an enlarged exterior view of the window regulator mechanism taken substantially along the line 8—8 of FIG. 7 looking in the direction of the arrows.

A tape 28 wraps around rollers 25 and 27 of the respective upper and lower roller assemblies 24 and 26. The tape 28 extends from the upper roller assembly 24 to the lower roller assembly 26 and lies substantially flat against the surface of base plate 20 facing the exterior side of closure 12 as best shown in FIG. 8. Tape 28 is attached to window sash plate 30 between rollers 25 and 27 on the exterior side of base plate 20 as more fully explained below. Window sash plate 30 is attached to the bottom of window 16 and is moved up and down with respect to base plate 30 by tape 28.

Window regulator mechanism 18 includes a reversible electric motor 32 and two tape drums 34 and 36 that are mounted on the interior side of base plate 20 near the middle of the closure 12 which is generally the widest part of the door. Base plate 20 is preferably curved to follow the outer panel of closure 12 and thus maximize the space available for these regulator parts. Tape drums 34 and 36 rotate on spaced parallel axes that are generally perpendicular to base plate 20. Motor 32 drives tape drum 34 through a gear reduction set (not shown). Drum 34 drives drum 36 in an opposite direction through meshing spur gears 38, 40 that are attached to the respective drums.

Tape 28 is attached to drum 36 at one end and then winds around drum 36, then exits drum 36, twists 90° and then wraps around roller 25 of upper roller assembly 24.

As indicated above tape 28 then lies substantially flat against the exterior surface of base plate 30 from the upper roller assembly 24 to the lower roller assembly 26. Tape 28 then wraps around roller 27 of lower roller assembly 26 and extends upwardly toward tape drum 34 on the interior side of base plate 20. Tape 28 twists 90° after wrapping around lower roller 27 and winds onto tape drum 34 with the opposite end of tape 28 being attached to tape drum 34. The number of times that tape 28 wraps around drums 34 and 36 depends on the position of window 16 with the total wrap of tape 28 on drums 34 and 36 being substantially equal to the required travel of window 16. In any event, enough tape is stored on drums 34 and/or 36 to move window 16 up and down between a raised fully closed position and a lowered fully stored position in closure 12.

Window 16 is raised and lowered by energizing reversible electric motor 32 through suitable electric controls that are well known in the art. Basically window 16 is lowered by energizing motor 32 so that tape drum 34 is driven clockwise as shown in FIG. 8. This winds additional tape onto drum 34 on the interior side of base plate 26 which pulls tape 28 down on the exterior side of base plate 20. As tape 28 is pulled down, window sash plate 30 and window 16 are pulled down with it. As indicated above tape drum 36 is simultaneously driven in the counterclockwise direction unwinding tape 28 at the opposite end.

On the other hand, window 16 is raised by energizing motor 32 to drive drum 34 counterclockwise and drum 36 clockwise. In this mode, tape 28 is wound on drum 36 at one end and simultaneously unwound from drum 34 at the other end. This pulls tape 28 up on the exterior side of base plate 20 raising sash plate 30 and window 16 to the closed position.

Thus tape 28 is always pulled to open or close window 16. Since tape 28 is not required to push window 16 in either direction, tape 28 can be made very thin and flexible and easy to route inside closure 12. Since tape 28 is very thin and flexible, tape 28 can also be wrapped around small rollers 25 and 27 at the upper and lower ends of base plate 20. For example, rollers 25 and 27 can be made approximately 0.375 inches (9.5 cm) in diameter. This results in a thin roller 25 and roller assembly 24 at the top of base plate 20 and allows locating upper roller assembly 24 very high in a thin sill area of closure 12 as shown schematically in FIG. 7. This feature provides considerable design freedom for closure 12 and increases the permissible height of window 16 which must be stored in closure 12.

Tape 28 is preferably a woven web of high tensile strength synthetic plastic material, such as nylon or polyester as is commonly used in seat belts. A tape ½ to ¾ inches wide and 0.040 of an inch in thickness is sufficient for most automotive applications.

When tape 28 is wound onto an empty drum and simultaneously wound off a full drum, slack is built-up initially because less tape is wound onto the empty drum than is wound off the full drum due to the thickness of the tape and the several layers of tape on the full drum from which the tape is being wound off. The slack is eventually taken up when the winding operation is completed. However, there is an ascetic problem when the window 16 is lowered partially because the slack builds up on the trailing side of the tape which holds the window 16 up when it is being pulled down. This slack is taken up by the window dropping as much as a quarter of an inch after the lowering operation ceases. The drop does not impair the lowering operation but the drop can be seen and it is displeasing from an ascetic standpoint. Consequently, window regulator mechanism 18 preferably includes a slack-take up device 40 to avoid window drop when the window is lowered partially.

Slack take-up device 40 comprises splitting tape 28 to form ends 42 and 44. Lower end 42 is anchored to window sash plate 30 securely. Upper end 44 is attached so that it moves vertically with respect to window sash plate 30 under the bias of compression spring 46. The upper end of compression spring 46 engages anchor tabs 48 of window sash plate 30. The lower end of compression spring 46 engages a slide 50 that is attached to the upper end 44 of tape 28 below stop tabs 52 of window sash plate 30. Slide 50 engages stop tabs 52 when window 16 is in the full down position and tape drum 34 is full of tape 28.

To raise an open window 16, drum 34 which contains several layers of tape 28 is driven counterclockwise. This drives drum 36 clockwise winding tape 28 onto drum 36 and pulling slide 50 up. Slide 50 being in engagement with stop tabs 52 pulls window 16 until window 16 is closed. During this window raising operation, slack is initially produced in tape 28 and then taken-up in the portion of tape 28 between drum 34 and end 42. However, this does not effect the operation because the window is pulled up by the portion of tape 28 between slide 50 and drum 36 which remains taut due to the weight of window 16 and sash plate 30 and the fact that the force of compression spring 46 exceeds the weight of these components. Consequently the window raising operation can be stopped at any time and a partially open window 16 will not drop.

To lower a closed window 16, drum 34 is driven clockwise. This drives drum 36 counterclockwise and winds several layers of tape 28 off of drum 36 and onto drum 34 pulling slide 50 down. During this window lowering operation, slack which would normally build up between stop tabs 52 and drum 36 is taken up by expansion of compression spring 46 which moves slide 50 away from stop tabs 52. When window 16 is closed, slide 50 re-engages stop tabs 52 because more tape is being wound onto drum 34 than is wound off drum 36 during the latter stages of the operation. The window lowering operation can be stopped at any time and the partially closed window 16 will not drop because any slack would be taken up by expansion of compression spring 46.

Figure 9:
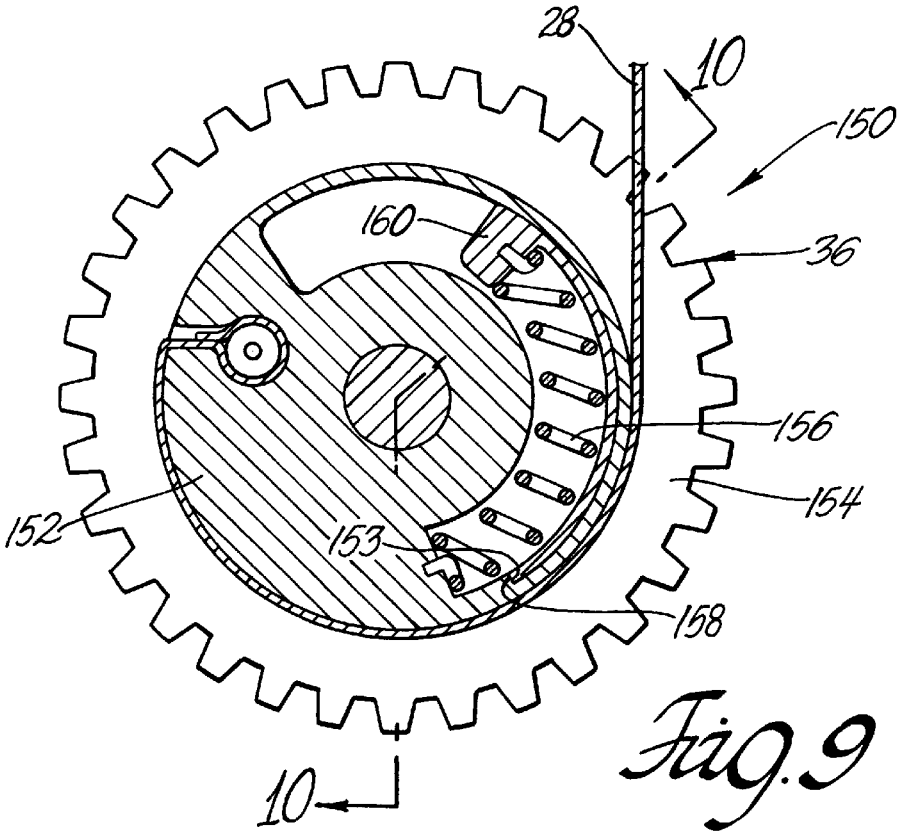
FIG. 9 is a front view partially sectioned of a modified component for the window regulator mechanism shown in FIGS. 1–8.
Figure 10:
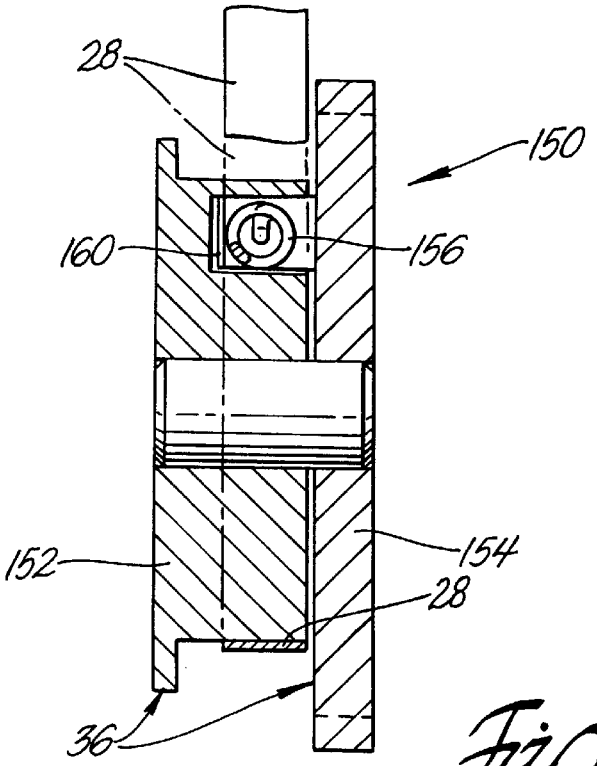
FIG. 10 is a section taken substantially along the line 10—10 of FIG. 9 looking in the direction of the arrows.

An alternate slack take-up device 150 is shown in FIGS. 9 and 10. In this instance both tape ends 42 and 44 are anchored to window sash plate 50 securely; the drum portion 152 of tape drum 36 is separated from the gear portion 154; and a compression spring 156 is operatively interposed between the drum portion 152 and the gear portion 154. Drum portion 152 includes a drive shoulder 153 while gear portion 154 includes a drive shoulder 158 and a stop tab 160.

When window 16 is raised to a closed position, gear portion 154 is driven clockwise by drum 34. Drive shoulder 158 engages drive shoulder 153 of drum portion 152 winding tape 28 onto drum portion 152. This pulls tape end 44 up and closes window 16. The window closing operation can be stopped at any time without window 16 dropping because shoulders 153 and 158 engage at all times during the window closing operation.

When window 16 is lowered to an open position, gear portion 154 is driven counterclockwise by the gear portion of drum 34 while drum portion 152 is driven counterclockwise by tape 28 being pulled off drum portion 152 by the drum portion of drum 34. Any would be slack in the portion of tape 28 between drum portion 152 and window sash plate 30 is taken up by expansion of compression spring 156. The window opening operation can be stopped at any time without window 16 dropping because window 16 is held up via an expanded spring 156.

Figure 11:
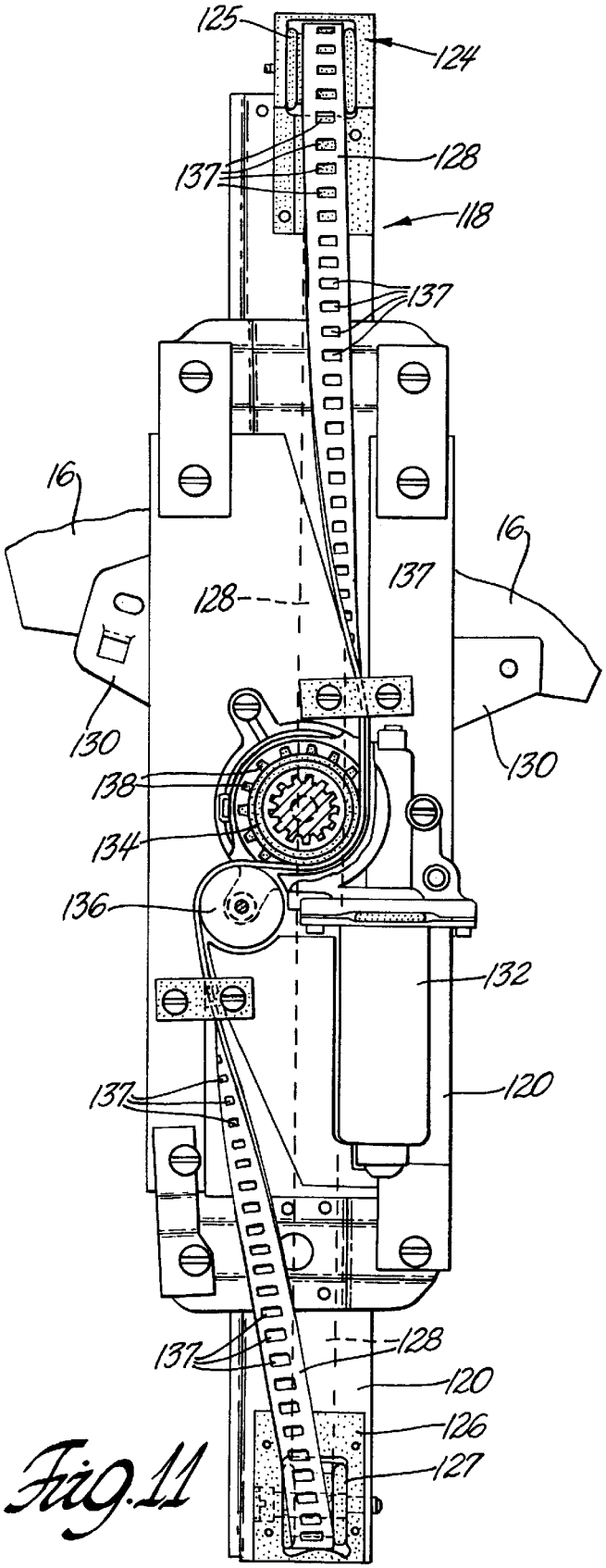
FIG. 11 is an enlarged fragmentary exterior view of an alternate window regulator mechanism.
Figure 12:
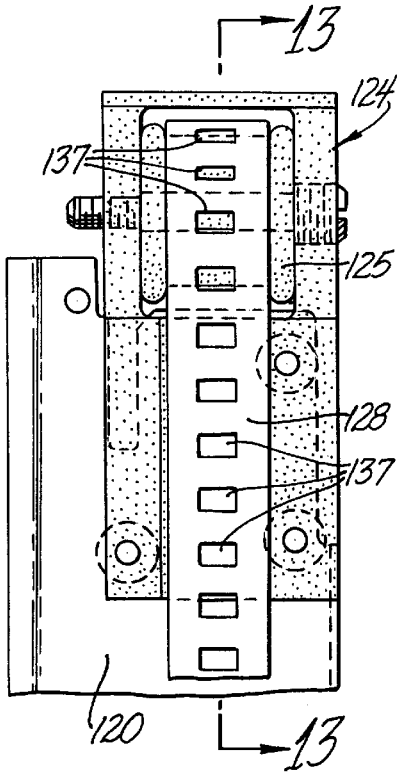
FIG. 12 is a further enlargement of an upper portion of FIG. 11.
Figure 13:
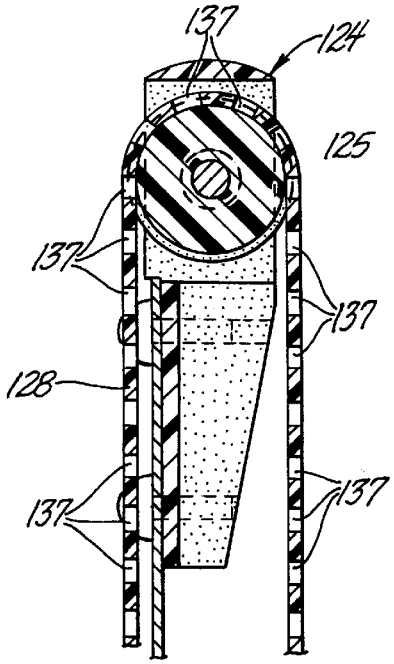
FIG. 13 is a section taken substantially along the line 13—13 of FIG. 12 looking in the direction of the arrows.

FIGS. 11, 12 and 13 show an alternate window regulator mechanism 118 that also uses a tape 128 that pulls the window in both directions.

Window regulator mechanism 118 comprises a base plate 120 that is disposed in a space between inner and outer panels of a closure (not shown) and secured to the inner panel by brackets (not shown). Base plate 120 has an upper roller assembly 124 at the upper end (FIGS. 12 and 13) and a lower roller assembly 126 at the lower end.

An endless tape 128 wraps around rollers 125 and 127 of the upper and lower roller assemblies 124 and 126. The tape 128 extends continuously from the upper roller assembly 124 to the lower roller assembly 126 and lies substantially flat against the surface of base plate 120 on the exterior side of the closure as best shown in FIG. 9. Window sash plate 130 is attached to tape 128 on the exterior side of base plate 120 between rollers 125 and 126 and to the bottom of window 16. Tape 128 can also be split to facilitate assembly. When split, the two ends of tape 128 are fastened to window sash plate 130 securely. Thus for all practical purposes tape 128 is an "endless" tape even when split for assembly purposes.

Window regulator mechanism 118 includes a reversible electric motor 132, a tape drum 134 and an idler drum 136 that are mounted on the interior side of base plate 120 near the middle of the closure which is generally the widest part of the closure. Base plate 120 is preferably curved to follow the outer closure panel and thus maximize the space available for these regulator parts. Tape drive drum 134 and idler drum 136 rotate on spaced parallel axes that are generally perpendicular to base plate 120. Motor 132 drives tape drive drum 134 through a gear reduction set (not shown).

Endless tape 128 wraps around tape drive drum 134 in one direction and then wraps around idler drum 136 in an opposite direction. Tape 128 then twists 90° and wraps around roller 127 of lower roller assembly 126.

As indicated above, endless tape 128 then lies substantially flat against the exterior surface of base plate 130 from the lower roller assembly 126 to the upper roller assembly 124. Endless tape 128 then wraps around roller 125 of upper roller assembly 124 and then extends downwardly toward tape drive drum 134 on the interior side of base plate 120. Tape 128 twists 90° after wrapping around upper roller 125 then proceeds onto tape drive drum 134. Endless tape 128 has a series of equally spaced conformations, such as slots 137 that receive equally spaced conformations, such as radial teeth 138 on drive drum 134 when tape 128 is wrapped around drive drum 134. Conformations 137 and 138 cooperate to form a driving connection between endless tape 128 and tape drive 134. Other conformations may be used to perform this driving function.

Window 16 is raised and lowered by energizing reversible electric motor 132 through suitable electric controls that are well known in the art. Basically window 16 is lowered by energizing motor 132 so that tape drive drum 134 is driven counterclockwise as shown in FIG. 9. This pulls tape 128 down on the exterior side of base plate 120. As tape 128 is pulled down, window sash plate 130 and window 16 are pulled down with it. On the other hand, window 16 is raised by energizing motor 132 to drive drum 134 clockwise. This pulls tape 128 up on the exterior side of base plate 120 raising sash plate 130 and window 16 to the closed position.

Thus tape 128 is always pulled to open or close window 16. Since tape 128 is not required to push window 16 in either direction, tape 128 can be relatively thin and flexible and easy to route inside the closure.

Window regulator mechanism 118 does not need a slack-take up device 40 or 150 because tape 128 is not wound onto one drum while being wound off another drum.

Obviously, many modifications and variations of the present invention in light of the above teachings may be made. It is, therefore, to be understood that, within the scope of the appended claims, the invention may be practiced otherwise than as specifically described.

We claim:

1. A window regulator mechanism for raising and lowering a window in a hollow closure between a closed position and an open position where the window is at least partially stored in the hollow closure comprising:

a base plate that is adapted to be mounted inside the hollow closure between inner and outer panels of the hollow closure, the base plate having an upper roller and a lower roller that is spaced from the upper roller in a vertical direction, a sash plate that is moveably attached to the base plate, on a side of the base plate that faces the outer panel of the closure, a tape engaging the upper roller and the lower roller and attached to the sash plate between the upper roller and the lower roller on the side of the base plate that faces the outer panel of the closure, a motor for driving the tape via a drum that engages the tape on an opposite side of the base plate, and means for twisting the tape between the upper roller and the drum and for twisting the tape between the drum and the lower roller so that the tape travels with its width parallel to the length of the closure between the upper roller and the lower roller on the side of the base plate that faces the outer panel of the closure.

2. The window regulator mechanism as defined in claim 1 wherein the upper roller has a first axis of rotation and the lower roller has a second axis of rotation that is substantially parallel to the first axis of rotation.

3. The window regulator mechanism as defined in claim 2 wherein the tape has a first end that is between the upper roller and the drum and a second end that is between the drum and the lower roller.

4. The window regulator mechanism as defined in claim 3 wherein the tape is a thin flexible web of synthetic plastic material.

5. The window regulator mechanism as defined in claim 2 wherein the tape is endless.

6. A window regulator mechanism for raising and lowering a window that slides up and down in a hollow closure between a raised closed position and a lowered open position where the window is at least partially stored in the hollow closure comprising:

a base plate that is adapted to be mounted in the hollow closure between inner and outer panels of the hollow closure, the base plate having an upper roller and a lower roller that is spaced from the upper roller in a vertical direction, a sash plate that is moveably attached to the base plate, on a side of the base plate that faces the outer panel of the closure, a tape engaging the upper roller and the lower roller and attached to the sash plate between the upper roller and the lower roller on the side of the base plate that faces the outer panel of the hollow closure with its width substantially parallel to the length of the hollow closure, and a motor driven drum for driving the tape, the motor driven drum engaging the tape on an opposite side of the base plate that faces the inner panel of the hollow closure.

7. A window regulator mechanism for raising and lowering a window that slides up and down in a hollow closure between a raised closed position and a lowered open position where the window is at least partially stored in the hollow closure comprising:

a base plate that is adapted to be mounted in the hollow closure between inner and outer panels of the hollow closure, the base plate having an upper roller and a lower roller that is spaced from the upper roller in a vertical direction, a sash plate that is moveably attached to the base plate, on a side of the base plate that faces the outer panel of the closure, a tape engaging the upper roller and the lower roller and attached to the sash plate between the upper roller and the lower roller on the side of the base plate that faces the outer panel of the hollow closure with its width substantially parallel to the length of the hollow closure, and a motor driven drum for driving the tape, the motor driven drum engaging the tape on an opposite side of the base plate, the upper roller having a first axis of rotation and the lower roller having a second axis of rotation that is substantially parallel to the first axis of rotation;

the motor driven drum having an axis of rotation that is substantially perpendicular to an imaginary plane containing the first and second axis, and the tape twisting substantially 90° between the upper roller and the drum and between the drum and the lower roller.

8. The window regulator mechanism as defined in claim 7 further comprising a second drum that engages the tape and that has an axis of rotation that is substantially parallel to the axis rotation of the first drum.

9. The window regulator mechanism as defined in claim 8 wherein the tape has a first end that is attached to one of the drums and a second end that is attached to another of the drums and wherein the drums are drivingly connected.

10. The window regulator mechanism as defined in claim 9 further including a spring for taking up any slack in the tape.

11. The window regulator mechanism as defined in claim 10 wherein the tape has an end anchored to the window sash plate securely and another end attached to the window sash plate by a slide that engages the spring.

12. The window regulator mechanism as defined in claim 10 wherein one of the drums is divided into a drum portion and a gear portion and the spring is interposed between the drum portion and the gear portion to take up slack in the tape during a window closing operation.

13. The window regulator mechanism as defined in claim 8 wherein the tape is endless and wherein one of the drums is an idler drum.

14. The window regulator mechanism as defined in claim 8 wherein the tape is endless and has conformations engaging conformations of the motor driven drum.

15. The window regulator mechanism as defined in claim 8 wherein the tape is a thin flexible web of synthetic plastic material.

16. A window regulator mechanism for raising and lowering a window that slides up and down in a hollow closure between a raised closed position and a lowered open position where the window is at least partially stored in the hollow closure comprising:

a base plate that is adapted to be mounted in the hollow closure between inner and outer panels of the hollow closure, the base plate having an upper roller and a lower roller that is spaced from the upper roller in a vertical direction, the upper roller having an axis of rotation that is substantially parallel to the length of the hollow closure and the lower roller having an axis of rotation that is substantially parallel to the axis of rotation of the upper roller;

a sash plate that is moveably attached to the base plate, on a side of the base plate that faces the outer panel of the closure, a tape engaging the upper roller and the lower roller and attached to the sash plate between the upper roller and the lower roller on the side of the base plate that faces the outer panel of the hollow closure, the tape having a thickness and a width that is substantially greater than the thickness, the tape having its width substantially parallel to the length of the hollow closure, and a motor driven drum for driving the tape, the motor driven drum engaging the tape on an opposite side of the base plate that faces the inner panel of the hollow closure.

* * * * *